United States Patent [19]

Mukai

[11] Patent Number: 4,913,246

[45] Date of Patent: Apr. 3, 1990

[54] ROTARY GAD FOR GROUND DRILL

[76] Inventor: Toshio Mukai, 20-24 2-chome Azukimochi, Hamamatsu-city, Shizuoka Prefecture, Japan

[21] Appl. No.: 253,798

[22] Filed: Oct. 5, 1988

[51] Int. Cl.[4] ..... E21B 10/44

[52] U.S. Cl. ..... 175/323; 175/394

[58] Field of Search ..... 175/19, 62, 323, 348, 175/331, 325, 377, 394, 395, 408

[56] References Cited

U.S. PATENT DOCUMENTS

| | | | |
|---|---|---|---|
| 864,544 | 8/1907 | Kessler et al. | 175/394 |
| 1,200,119 | 10/1916 | Keeler | 175/408 |
| 1,522,368 | 1/1925 | Hoke | 175/394 |
| 2,349,033 | 5/1944 | Elliott | 175/394 |
| 2,352,412 | 6/1944 | Sandstone | 175/323 |
| 3,391,544 | 7/1968 | Daczko | 175/323 |
| 3,747,701 | 7/1973 | Atkins et al. | 175/323 |

*Primary Examiner*—Bruce M. Kisliuk

*Attorney, Agent, or Firm*—Jordan and Hamburg

[57] ABSTRACT

A rotary gad for a ground drill includes an elongated front body having a front end and a rear end with front spiral blades being disposed on the outside of the front body. The front body has an elongated front axial passage, and a front core rod is disposed in the front axial passage. The front body is rotatable about the front core rod. The front core rod has a front end and a rear end. An elongated rear body has a similar construction and a pushing section is provided on a rear axial passage in the rear body. The pushing section has a front side and a rear side. A rear ball element is disposed between the rear side of the pushing section and the front end of a rear core rod, and a front ball element is disposed between the front side of the pushing section and the rear end of the front core rod. Coupling means couple the front and rear bodies to provide for rotation of the front and rear bodies in opposite directions about the front and rear core rods.

4 Claims, 3 Drawing Sheets

ROTARY GAD FOR GROUND DRILL

DETAILED DESCRIPTION OF THE INVENTION

1. Field of Art of the Invention

The present invention relates to a rotary gad for a ground drill and more particularly to a rotary gad provided at the front end of a ground drill for drilling the ground to bury pipes or the like in the ground in such works as water supply equipment, drainage equipment and piping for telephone, electricity and gas supply.

2. Background of the Invention

In the conventional ground drilling works for piping, etc. using a hydraulic machine and other equipment, a screw or a driving pipe is rotated, or the whole of a driving pipe equipment provided with such screw or driving pipe is rotated for driving and drilling.

In this case, however, the machinery and equipment are large-scaled, and therefore cannot be used a narrow place, and also in point of cost there has been a problem. Further, the driving and drilling method using a gad fixed to a driving pipe involves the problem that the driving direction is very unstable due to a change in the angle of the gad tip, distortion of the driving pipe, a change in the mounting angle of a hydraulic cylinder, etc. or a change in the nature of the soil.

OBJECT OF THE INVENTION

The present invention, which has been proposed to overcome the above-mentioned problems, aims at providing a ground drill gad wherein the gad alone is rotated to stabilize the driving and drilling direction and thereby operates in an exact manner.

SUMMARY OF THE INVENTION

According to the present invention there is provided a rotary gad for a ground drill, comprising a thick base portion; a body portion contiguous to the base portion, the body portion having a gad tip formed at an acute angle at the front end thereof; a plurality of spiral blades formed on the peripheral wall of the body portion; a hollow portion formed in the interior of the gad; and a core rod disposed within the hollow portion, the gad being rotatable about the outer periphery of the core rod. Also provided is a rotary gad for a ground drill, comprising front and rear rotary gad sections contiguous to each other, the front rotary gad section comprising a thick base portion; a body portion contiguous to the base portion; the body portion having a gad tip formed at an acute angle at the front end thereof; a plurality of spiral blades formed on the peripheral wall of the body portion; a hollow portion formed in the interior of the front gad section; and a core rod disposed within the hollow portion, the front rotary gad section being rotatable about the outer periphery of the core rod, the rear rotary gad section comprising a thick base portion; a body portion contiguous to the base portion, the body portion having spiral blades formed on the peripheral wall thereof, the spiral blades extending in a direction opposite to the spiral direction of the spiral blades of the front rotary gad section; a hollow portion formed in the interior of the rear gad section; and a core rod disposed within the hollow portion, the rear rotary gad section being rotatable about the outer periphery of the core rod in a direction opposite to the rotating direction of the front rotary gad section.

DESCRIPTION OF THE PREFERRED EMBODIMENTS

Embodiments of the present invention will be described in detail hereinunder with reference to the accompanying drawings.

Figure 1:
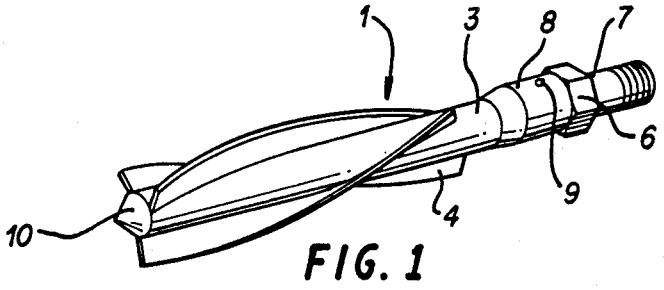
FIG. 1 is a perspective view showing the whole of a rotary gad.
Figure 2:
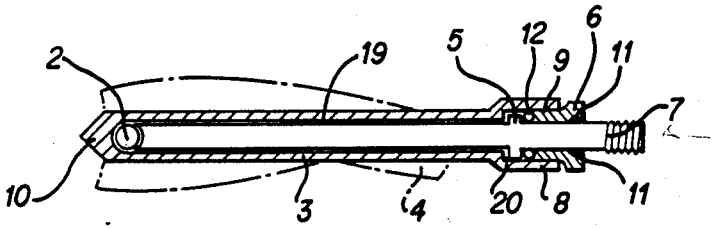
FIG. 2 is a longitudinal sectional view thereof.

FIG. 1 is an entire perspective view of a rotary gad. The gad, indicated by the reference numeral 1, rotates about a core rod 7. This is based on the following construction. The core rod 7 is positioned within a hollow portion 19 formed in a body portion 3; a core rod stop 5 is retained at the front end thereof by an inner wall 20 of the base portion and at the rear end thereof by a nut 6 which is fitted into the base portion 8 threadedly from behind and fixed thereto with a set-screw 9; and a ball 2 is disposed between the front end of the hollow portion 19 and that of the core rod 7 to ensure rotation at the front end of the core rod 7.

When the core rod 7 pushes the ball 2, the gad 1 rotates under the pressure of the earth applied to spiral blades 4. The ball 2 is for minimizing the contact pressure between the front end face of the hollow portion and that of the core rod to facilitate the rotation of the gad. To this end, it is necessary that the contacting faces with the ball 2 be each in the form of a semi-spherical configuration.

Figure 3:
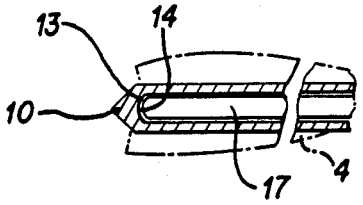
FIG. 3 is a partial, longitudinal sectional view of a rotary gad according to another embodiment of the invention.
Figure 4:
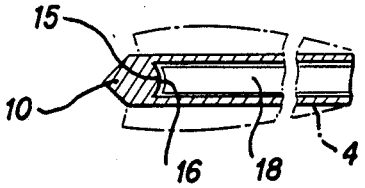
FIG. 4 is a partial, longitudinal sectional view showing a further embodiment.
Figure 5:
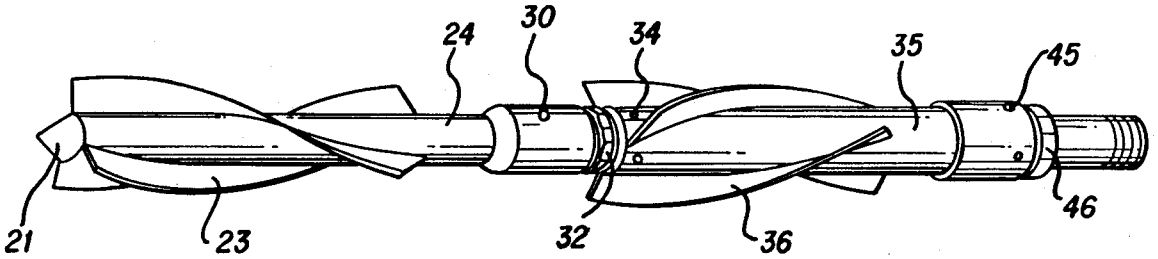
FIG. 5 is a perspective view of the whole of a rotary gas having a two-stage construction.
Figure 6:
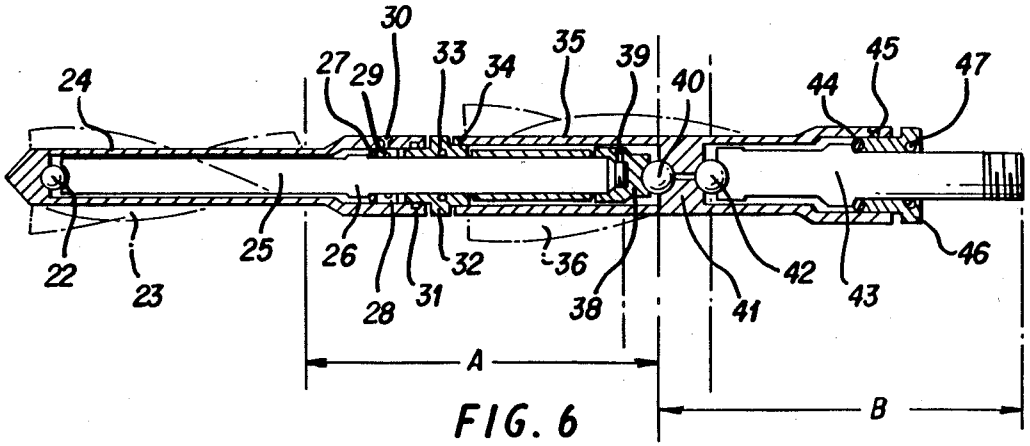
FIG. 6 is a longitudinal sectional view thereof.
Figure 7:
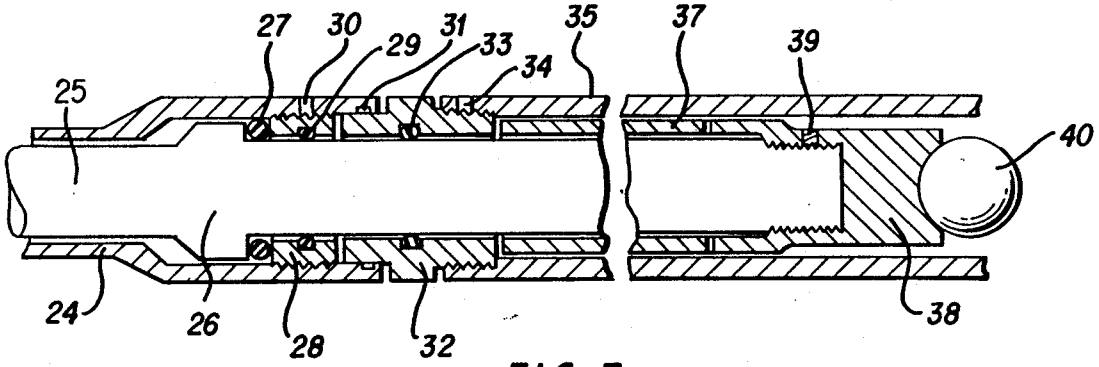
FIG. 7 is an enlarged view of portion A in FIG. 6.
Figure 8:
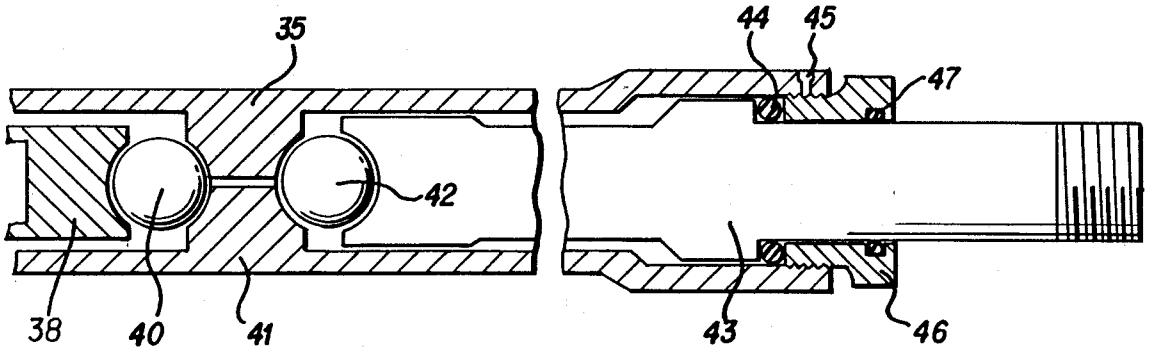
FIG. 8 is an enlarged view of portion B in FIG. 6.

In place of using the ball 2 there also may be adopted such constructions as shown in FIGS. 3 and 4 wherein one of the front end face of the hollow portion and that of the core rod is formed in the shape of a semi-spherical concave and the other in the shape of a semi-spherical convex and both are rotatably contacted with each other. This construction is also effective. FIG. 3 illustrates an embodiment wherein the front end face of the hollow portion is formed in the shape of a semi-spherical concave 13 and that of a core rod 17 in the shape of a semi-spherical convex 14, while FIG. 4 illustrates an embodiment wherein the front end face of the hollow portion is formed as a semi-spherical convex 15 and that of a core rod 18 as a semi-spherical concave 16.

A bearing 12 is for reducing the contact resistance between the core rod 5 and the nut 6 when pulling out the gad 1 halfway and for preventing a driving pipe or any other member from being unscrewed by reverse rotation of the gad 1. Inside the nut 6 is disposed an O-ring 11 which is provided for preventing the leakage of oil from the interior of the gad and also preventing the ingress of water, sand, etc. from the exterior into the gad.

Under such construction, the core rod 7 pushes the ball 2 when driving force is exerted thereon, whereby the ground is drilled. In this case, the contact point of the pressure applied to the core rod 7 is always on the ball 2 positioned near the front end of the gad even when the driving and drilling distance is long, so that the driving and drilling direction is very stable without deviation even upon distortion of the core rod 7, change in the nature of the soil or other changes. In order to enhance stabilization it was better that the gad tip 10 does not project so too much from the front end of the spiral blades 4.

Reference will now be made to the results so far obtained in actual use of the rotary gad at fifty-two places with water supply pipe taking-out. The operation were conducted under the following condition. An asphat-paved road 8.3 m wide saved on a pebble-mixed red earth layer, a water supply pipe positioned 0.8 m from the shoulder, and a drilling width of 7.2 m exclusive of a working width of 1.1 m. The time required for drilling and piping was about three hours (two plumbers). In the case of excavation for the same road conditions, there were required workers for asphalt cutting, roadbed chipping and operation of a small-sized back hoe, as well as workers for plumbing, traffic control, removal of surplus soil and temporary restoration of the road surface, which required additional six workers, and about six hours was required for the work. According to the present invention, the number of workers required is reduced to one sixth; besides, the workers and materials for the restoration of the road surface are no longer necessary, so a great reduction in cost can be attained. Additionally, the operation can be completed in a short period without damage to the road surface and without being an obstacle to traffic.

Also when filled earth a gravel layer with red clay mixed therein was drilled over a length of 3 m at depths of 100 mm, 75 mm and 50 mm, there was obtained a similar effect.

Another embodiment of the present application is shown in FIGS. 5 to 8. A rotary gad according to this invention is of a two-stage construction of front and rear sections, one of which rotates in a forward direction and the other rotates in the reverse direction about core rods 25 and 43. This is because of the following construction. The core rod 25 is positioned within hollow body portions 24 and 35; a core rod stop 26 is retained at the front part thereof by the inner wall of a base portion while in a rear position, a stop screw 38 is connected to the rear end of the core rod 25, which stop screw is in pressure contact with a pushing portion 41 through a ball 40. The core rod 43 is positioned within the hollow portion 35 and a core rod stop 43 thereof is retained at the front part thereof by the inner wall of a base portion while the rear part thereof is retained by a nut 46 which is fitted into the base portion threadedly from behind and fixed to the base portion with a set-screw 45; and there are disposed balls 22, 40 and 42, whereby the body portions 24 and 35 are rendered rotatable.

When the core rod 25 pushes the ball 22, the body portion 24 rotates by virtue of the pressure of the earth exerted on spiral blades 23. The ball 22 is for minimizing the contact resistance between the front end face of the hollow portion and that of the core rod to facilitate the rotation of the body portion 24. To this end, it is necessary that the faces in contact with the ball 22 be each formed in the shape of a semi-spherical concave.

On the other hand, when the core rod 43 pushes the ball 42, the body portion 35 rotates by virtue of the pressure of the earth exerted on spiral blades 36. Besides, since the spiral direction of the blades 23 and that of the blades 36 are opposite to each other, one rotates in a forward direction and the other rotates in the reverse direction. Consequently, there are attained a total of twice the revolutions as the revolutions only in one direction, thus affording an extremely high accuracy in the drilling direction. In this connection, it became clear that if the torsional angle of the spiral was made too large, it would result in adhesion of soil to the spiral blades and hindrance of the rotation.

The body portions 24 and 35 are coupled together through a coupling 32. An O-ring 33 is disposed in the coupling for the protection of the core rod 25. Further, the coupling 32 is fixed to the body portion 35 with a set-screw 34. Numeral 31 denotes an O-ring.

A core rod stop screw 28 is threadedly fitted into the body portion 24 and is fixed with a set-screw 30. Numeral 29 denotes an O-ring.

A bearing 27 is provided for reducing the contact resistance between the core rod stop 26 and the coupling 32 when pulling out the gad halfway and for preventing a driving pipe or any other member from being unscrewed by reverse rotation of the gad.

A bearing 44 also fulfills a similar function. A nut 46 is threadedly fitted into the base part of the body portion 35 and is fixed with a set-screw 45. Inside the nut 46 is disposed an O-ring 47 which is for preventing the leakage of oil from the interior of the gad and also preventing the ingress of water, sand, etc. from the exterior into the gad.

A cylinder 37 is provided for connecting the core rod 25 and the body portion 35 at the time of pulling out the gad. The stop screw 38 is fixed to the core rod 25 through a setscrew 39 and engages the pushing portion 41 through the ball 40. The set screw 39 prevents the cylinder 37 from coming off the core rod 25.

With such a construction, when a driving force is exerted on the core rods 43 and 25, these rods push the balls 42, 40 and 22, whereby the ground is drilled. In this case, even if the driving and drilling distance becomes longer, there is attained a very high accuracy of the driving and drilling direction because the contact point of the pressure applied to the core rods 43 and 25 is always on the ball 22 positioned near the gad tip 21 and also because of the long body. Besides, the adhesion of soil to the spiral blades due to the long body can be kept to a minimum because the rotating direction of the spiral blades 23 and that of the spiral blades 36 are opposite to each other.

According to the present invention, as set forth hereinabove, there is also proposed a construction whereby a driving pressure is provided in the vicinity of the front end of the gad and wherein the body portion is made long and the rotating direction of the spiral blades is varied. Consequently, it is possible to provide a rotary gad for a ground drill capable of operating in an exact manner at low cost in a short period while stabilizing the driving and drilling direction even under adverse conditions.

I claim:

1. A rotary gad for a ground drill comprising an elongated front body having a front end and a rear end, front spiral blades disposed on the outside of said front body, said front body having an elongated front axial passage, a front core rod means disposed in said front axial passage, said front body being rotatable about said front core rod means, said front core rod means having a front end and a rear end, an elongated rear body having a front end and a rear end, said rear body being disposed in axial alignment with said front body, rear spiral blades disposed on the outside of said rear body, said rear spiral blades extending in a spiral direction opposite to the spiral direction of said front spiral blade, said rear body having an elongated rear axial passage axially aligned with said front axial passage, a rear core rod means disposed in said rear body, said rear body being rotatable about said rear core rod means, said rear core rod means having a front end and a rear end, said rear body having a front end portion, said rear end of said front core rod means extending into said front end portion of said rear body, a pushing section in said rear axial passage, said pushing section having a front side and a rear side, a rear ball element between said rear side of said pushing section and said front end of said rear core rod means, and a front ball element between said front side of said pushing section and said rear end of said front core rod means, and coupling means coupling said front and rear bodies to provide for rotation of said front and rear bodies in opposite directions about said front and rear core rod means.

2. A rotary gad according to claim 1, wherein said front end of said front body has a front tip, said front axial passage having a front terminating end juxtaposed to said front tip, and a third ball element between said front terminating end and said front end of said front core rod means.

3. A rotary gad according to claim 1, wherein said front core rod means comprises an elongated front rod and a stop screw means mounted on said front rod, said front ball element being disposed between said stop screw means and said front side of said pushing section.

4. A rotary gad according to claim 1, wherein said coupling means comprises a coupling element and securing means securing said coupling element to said rear body.

* * * * *